United States Patent [19]

Stapleton

[11] Patent Number: 4,685,579

[45] Date of Patent: Aug. 11, 1987

[54] TAMPER PROOF BOTTLE

[76] Inventor: Gerard V. Stapleton, 10 Spruce St., Garden City, N.Y. 11530

[21] Appl. No.: 915,580

[22] Filed: Oct. 6, 1986

[51] Int. Cl.[4] ..... B65D 55/02

[52] U.S. Cl. ..... 215/230; 206/532; 206/534; 206/540; 206/807; 215/231; 215/366

[58] Field of Search ..... 215/230, 231, 366; 206/807, 532, 534, 540, 459

[56] References Cited

U.S. PATENT DOCUMENTS 2,857,068 10/1958 Kraepelin ..... 215/231

4,601,404 7/1986 Shivers ..... 215/230

*Primary Examiner*—Donald F. Norton

*Attorney, Agent, or Firm*—Michael I. Kroll

[57] ABSTRACT

A tamper proof bottle is provided so that when a person removes a cap from a collar on a container an attached line therebetween causes a membrane within a recessed portion of the cap to break allowing dye liquid to come out onto a cotton padding above pills therein.

7 Claims, 6 Drawing Figures

STEP 1
INVERT CAP AND
POUR DYE LIQUID
STEP 2
INSERT LINE
STEP 3
SEAL MEMBRANE OVER
DYE LIQUID AND LINE
STEP 4
ATTACH OTHER
END OF LINE
TO INSIDE OF
COLLAR &
SEAL COLLAR
ONTO
CONTAINER
PULL TO
OPEN

TAMPER PROOF BOTTLE

BACKGROUND OF THE INVENTION

1. Field of the Invention

The instant invention relates generally to closures for bottles and more specifically it relates to a tamper proof bottle.

2. Description of the Prior Art

Numerous closures for bottles have been provided in prior art that are adapted to include stoppers for sealing necks of the bottles so as to protect contents within the bottles. For example U.S. Pat. Nos. 879,740; 2,136,896 and 2,198,117 all are illustrative of such prior art. While these units may be suitable for the particular purpose to which they address, they would not be as suitable for the purposes of the present invention as heretofore described.

SUMMARY OF THE INVENTION

A primary object of the present invention is to provide a tamper proof bottle that will overcome the shortcomings of the prior art devices.

Another object is to provide a tamper proof bottle so that when a person removes a cap from a collar an attached line therebetween causes a membrane to break allowing dye liquid to fall on top of cotton above capsules/tablets therein.

An additional object is to provide a tamper proof bottle which will prevent insertion of a knife or razor between the cap and collar to slit the line and otherwise tamper with the cap.

A further object is to provide a tamper proof bottle that is simple and easy to use.

A still further object is to provide a tamper proof bottle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 3A, 3B, 3C:
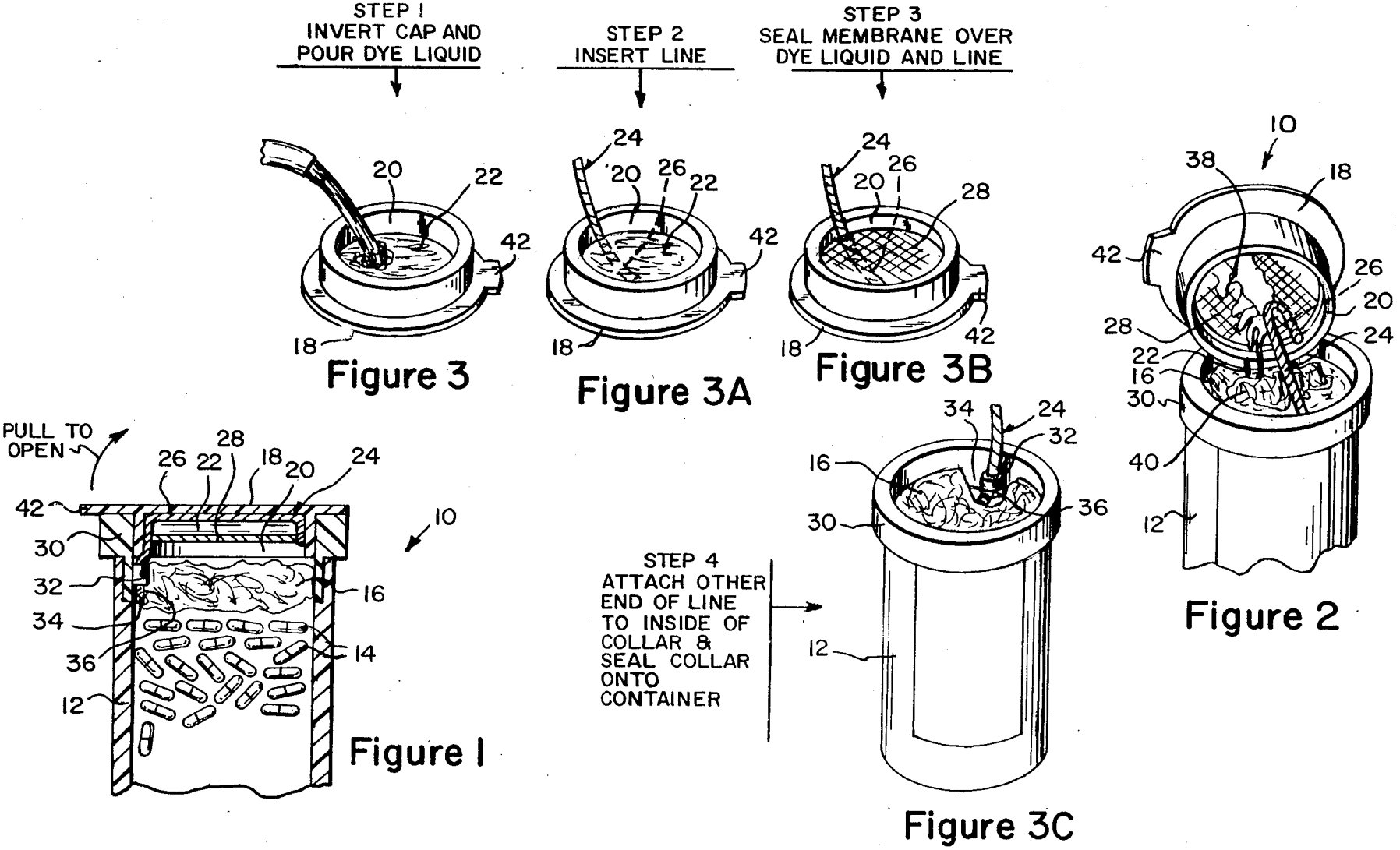
FIG. 1 is a cross sectional view of the invention.
FIG. 2 is a perspective view showing cap being removed from collar causing membrane to break, allowing dye liquid to fall onto cotton padding within container.
FIG. 3 is a perspective view of cap inverted showing dye liquid being poured within recessed portion of the cap.
FIG. 3A is a perspective view similar to FIG. 3 showing one end of line inserted within dye liquid in recessed portion.
FIG. 3B is a perspective view similar to FIG. 3A showing membrane sealed over dye liquid and end of line.
FIG. 3C is a perspective view of collar sealed onto container after other end of line is attached to retainer inside the collar.

Turning now descriptively to the drawings, in which similar reference characters denote similar elements throughout the several views, FIGS. 1 and 2 illustrate a tamper proof bottle 10 consisting of a container 12 for holding a plurality of items 14 within. An absorbent padding 16 is placed on top of items 14 within container 12. A cap 18 is provided that has a recessed portion 20 in which a liquid 22 is placed within the recessed portion of the cap when the cap 18 is inverted as shown in step one in FIG. 3.

A line 24 has a first end 26 inserted within the liquid 22 and against the recessed portion 20 of the cap 18 as shown in step two in FIG. 3A. A waterproof membrane 28 is sealed over the liquid 22 and first end 26 of the line 24 as shown in step three in FIG. 3B.

A collar 30 has a retainer 32 on inside wall 34 thereof so that second end 36 of the line 24 can be secured to the retainer 32 after the recessed portion 20 of the cap 18 is inserted within the collar 30 as shown in step 4 in FIG. 3C. The collar is then permanently attached, at 36 by a standard heat sealing or annealing process, to top of the container 12 As shown in FIG. 2, when a person removes the cap 18 from the collar 30 the line 24 will pull on the membrane 28 causing the membrane to break at 38 allowing the liquid 22 to come out and wet at 40 the padding 16 within the container 12.

The items 14 within the container 12 are pills such as tablets and capsules. The absorbent padding 16 is a white piece of soft cotton wadding. The cap 18 includes a lift tab 42 to facilitate removal of the cap from the collar 30. The liquid 22 is a colored vegetable dye solution, such as red or blue, so as to be immediately recognizable on the cotton wadding 16 when the membrane 28 is broken. The line 24 is a strong durable cord while the waterproof membrane 28 is fabricated out of a thin plastic foil material.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

The essence of the aforsaid invention is that when membrane 28 ruptures white ootton 16 therebelow will take on the color of dye 22 and accordingly the user will immediately be made aware that the container has been previously opened.

What is claimed is:

1. A tamper proof bottle comprising:

(a) a container for holding a plurality of items within;

(b) an absorbent padding placed on top of said items within said container;

(c) a cap having a recessed portion;

(d) a liquid placed within said recessed portion of said cap when said cap is inverted;

(e) a line having a first end inserted within said liquid and against said recessed portion of said cap;

(f) a waterproof membrane sealed over said liquid and said first end of said line; and (g) a collar having a retainer on the inside wall thereof with the second end of said line secured to said retainer said collar permanently attached to top of said container, whereby when a person removes said cap from said collar said line will pull on said membrane causing said membrane to break allowing said liquid to come out and wet said padding within said container.

2. A tamper proof bottle as recited in claim 1, wherein said items within said container are pills such as tablets and capsules.

3. A tamper proof bottle as recited in claim 2, wherein said absorbent padding is a piece of soft cotton wadding.

4. A tamper proof bottle as recited in claim 3, wherein said cap includes a lift tab to facilitate removal of said cap from said collar.

5. A tamper proof bottle as recited in claim 4, wherein said liquid is a colored vegetable dye solution so as to be immediately recognizable on said cotton wadding when said membrane is broken.

6. A tamper proof bottle as recited in claim 5, wherein said line is a strong durable cord.

7. A tamper proof bottle as recited in claim 6, wherein said waterproof membrane is fabricated out of a thin plastic foil material.

* * * * *